US012480507B1

(12) United States Patent
Huang

(10) Patent No.: US 12,480,507 B1
(45) Date of Patent: Nov. 25, 2025

(54) PORTABLE OSCILLATING FAN

(71) Applicant: Di Huang, Shenzhen (CN)

(72) Inventor: Di Huang, Shenzhen (CN)

(73) Assignee: Di Huang, Shenzhen (CN)

( * ) Notice: Subject to any disclaimer, the term of this patent is extended or adjusted under 35 U.S.C. 154(b) by 0 days.

(21) Appl. No.: 18/890,091

(22) Filed: Sep. 19, 2024

(51) Int. Cl.
*F04D 25/10* (2006.01)
*F04D 19/00* (2006.01)
*F04D 25/06* (2006.01)

(52) U.S. Cl.
CPC ..... *F04D 25/105* (2013.01); *F04D 25/0673* (2013.01); *F04D 19/002* (2013.01)

(58) Field of Classification Search
CPC ... F04D 19/002; F04D 25/0673; F04D 25/105
See application file for complete search history.

(56) References Cited

U.S. PATENT DOCUMENTS 5,256,039 A * 10/1993 Crawford ..... F04D 27/00 416/246
5,411,371 A * 5/1995 Chen ..... F04D 25/105 416/100
2022/0136515 A1* 5/2022 Oelke ..... G06T 7/20 700/276

FOREIGN PATENT DOCUMENTS

CN 203770162 U * 8/2014
CN 210397196 U * 4/2020
DE 202017104832 U1 * 10/2017 ..... F04D 19/002

OTHER PUBLICATIONS

Machine translation of CN-203770162-U (Year: 2014).*
Machine translation of CN-210397196-U (Year: 2020).*
Machine translation of DE-202017104832-U1 (Year: 2017).*

* cited by examiner

*Primary Examiner* — Nathaniel E Wiehe
*Assistant Examiner* — Jason G Davis
(74) *Attorney, Agent, or Firm* — Nitin Kaushik

(57) ABSTRACT

The present invention relates to a portable oscillating fan designed for enhanced usability and convenience. It features a rear cover, mounting cavity, mounting plate, battery, charging module, and motor fan, among other components. The fan's unique structure allows for oscillating airflow, controlled by a switch circuit board connected to an oscillation motor. The fan can be easily fixed in different positions using adjustable leg tubes and is powered by a rechargeable battery. The compact design provides ease of storage and practical functionality, making it suitable for various environments.

4 Claims, 3 Drawing Sheets

PORTABLE OSCILLATING FAN

FIELD OF THE DISCLOSURE

The present invention relates to the technical field of fan, specifically to a portable oscillating fan.

BACKGROUND OF THE DISCLOSURE

The present invention relates to the field of octopus fans, particularly to a portable oscillating fan. During hot summer days, people choose various ways to cool down, such as using air conditioners and fans. However, in places with limited conditions, such as student dormitories or construction site dormitories, people often rely only on fans for cooling. For both household and outdoor use, convenience in installation and storage are crucial factors affecting the practicality of a fan. Existing fans in the prior art are not convenient to operate, take up a lot of space, and are not easy to store. They are also not easy to support and fix during use, which poses significant limitations.

In the prior art, CN203770162U discloses a foldable and retractable fan, including a support base, a connecting rod that can be detachably connected to one end of the support base, a rotor hinged to the other end of the connecting rod, and fan blades that can be detachably fixed on the rotor. The support base has multiple deformable leg tubes, each including an alloy core wire and a protective layer covering the periphery of the alloy core wire, with multiple protrusions along its length. The connecting rod comprises a first hollow rod and a second hollow rod fitted within the first hollow rod. The end of the first hollow rod is provided with an eccentrically hinged pressure buckle. The fan blades include a main blade and a sub-blade hinged to it. The connection ends of the main and sub-blades are correspondingly provided with a hole buckle and a snap buckle.

The above technical solution addresses the problems raised in the background art but has a limited blowing range, generally only blowing in one direction, which is inconvenient

SUMMARY OF THE DISCLOSURE

The purpose of the present invention is to solve the problems raised in the background art by designing a portable oscillating fan. To achieve the above objective, the present invention provides a portable oscillating fan, comprising a rear cover, a mounting cavity, a mounting plate, a battery, a charging module, a charging interface, a switch circuit board, a power switch, an oscillation switch, a motor fan, a front cover, a receiving groove, a mounting base, leg tubes, and an oscillation motor. The rear part of the rear cover is fitted with a mounting cavity, and a mounting plate is installed inside the rear cover. A battery is installed in the mounting cavity behind the mounting plate, and a charging module is installed above the battery at the rear of the mounting cavity. The charging interface is installed on the charging module. The switch circuit board is installed on the upper part of the mounting plate, and the power switch and oscillation switch are installed on the switch circuit board. The motor fan is installed at the front of the mounting plate. A front cover is installed on the front of the rear cover. A receiving groove is arranged below the mounting cavity on the rear cover, and a mounting base is rotatably installed inside the receiving groove. Multiple leg tubes are installed on the lower part of the mounting base. An oscillation motor is installed at the lower part inside the mounting cavity, and the output end of the oscillation motor is connected to the mounting base.

Further, the lower part of the mounting plate is provided with a positioning protrusion, and the receiving groove is provided with a positioning slot, wherein the positioning protrusion falls into the positioning slot when in the installed state.

Further, the motor fan is a fan structure with a motor installed in the center.

Further, the upper end of each leg tube is provided with a protrusion, and the leg tubes are inserted into the lower part of the mounting base through the protrusions on top.

Further, the oscillation motor is a motor integrated with a forward and reverse rotation circuit. The oscillation motor is electrically connected to the battery through the oscillation switch and the switch circuit board. The motor fan is electrically connected to the battery through the power switch and the switch circuit board. The charging module is electrically connected to the battery.

The present invention provides a portable oscillating fan with the following beneficial effects: The design of this device allows the fan to be easily fixed in different positions by changing the shape of multiple leg tubes. The charging interface, in conjunction with the charging module, allows for convenient charging of the battery. When blowing air is needed, the power switch is turned on, and the switch circuit board connects the power supply of the battery and the motor fan, causing the motor fan to operate and blow air. When it is necessary to increase the blowing range, the oscillation switch is turned on, which powers the oscillation motor through the battery. The output end of the oscillation motor is connected to the mounting base, thereby driving the mounting cavity and subsequently the rear cover to rotate back and forth, increasing the range of the airflow angle. The mounting base, in conjunction with the receiving groove, limits the position of the mounting base while saving space. The fan has a compact structure and strong practicality.

BRIEF DESCRIPTION OF DRAWINGS

These and other features and advantages of the present invention will become better understood with regard to the following description and accompanying drawings in which.

Figure 1:
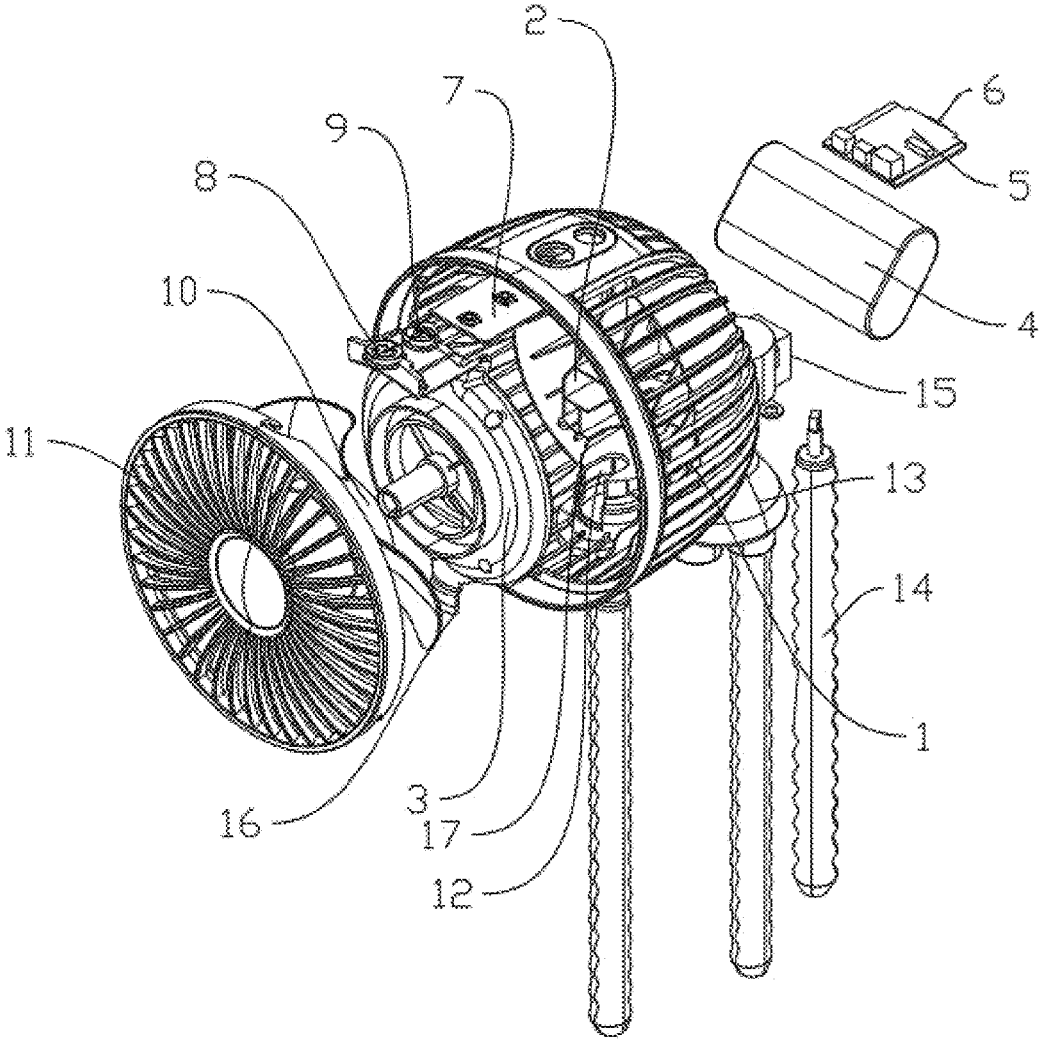
FIG. 1 is an exploded structural schematic view of the portable oscillating fan according to the present invention.

In the drawings: 1. Rear cover: 2. Mounting cavity: 3. Mounting plate: 4. Battery: 5. Charging module. 6. Charging interface: 7. Switch circuit board: 8. Power switch: 9. Oscillation switch; 10. Motor fan: 11. Front cover: 12. Receiving groove: 13. Mounting base: 14. Leg tubes: 15. Oscillation motor: 16. Positioning protrusion: 17. Positioning slot.

DETAILED DESCRIPTION

The technical solutions of the embodiments of the present invention will be clearly and completely described below in conjunction with the accompanying drawings. It is evident that the described embodiments are merely a part of the embodiments of the present invention and not all of them. Based on the embodiments in the present invention, all other embodiments obtained by those skilled in the art without creative efforts shall fall within the scope of protection of the present invention.

In the description of the present invention, it should be noted that the terms "upper/lower end," "inner," "outer," "front end," "rear end," "both ends," "one end," "the other end," etc., indicating orientations or positional relationships are based on the orientations or positional relationships shown in the drawings. They are merely for the convenience of describing the present invention and simplifying the description, rather than indicating or implying that the referred devices or elements must have a specific orientation, be constructed, and operated in a specific orientation. Therefore, they should not be understood as limitations to the present invention. Moreover, the terms "first," "second," etc., are used for descriptive purposes only and should not be understood as indicating or implying relative importance.

In the description of the present invention, it should be noted that unless otherwise expressly specified and defined, the terms "install," "set/fitted," "fit," "connect," etc., should be understood in a broad sense. For example, "connect" can be a fixed connection, a detachable connection, or an integrated connection: it can be a mechanical connection or an electrical connection: it can be directly connected or indirectly connected through an intermediary medium: it can be internal communication between two components. For those of ordinary skill in the art, the specific meanings of the above terms in the present invention can be understood in specific cases.

Figure 2:
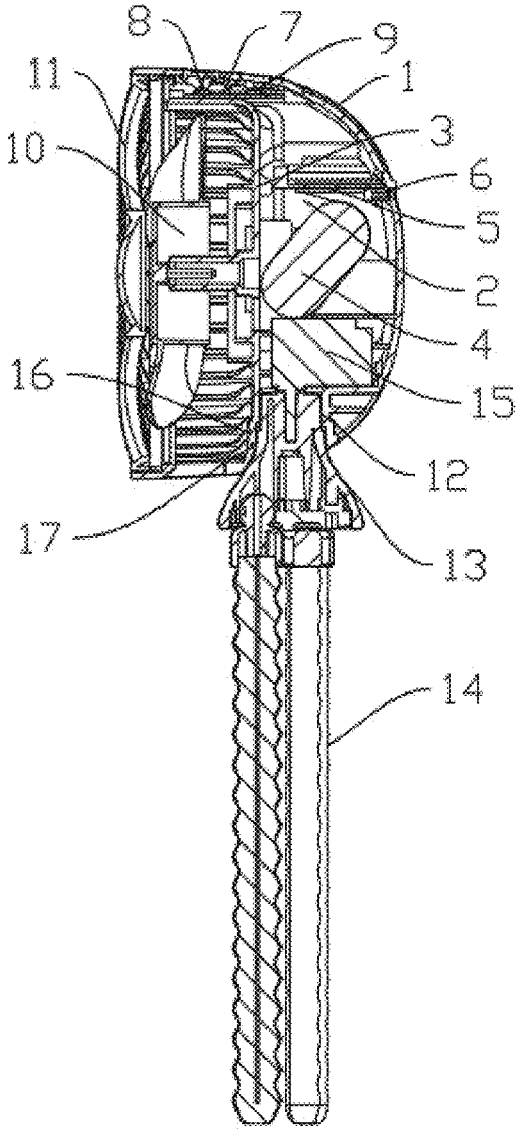
FIG. 2 is a side cross-sectional schematic view of the portable oscillating fan according to the present invention.
Figure 3:
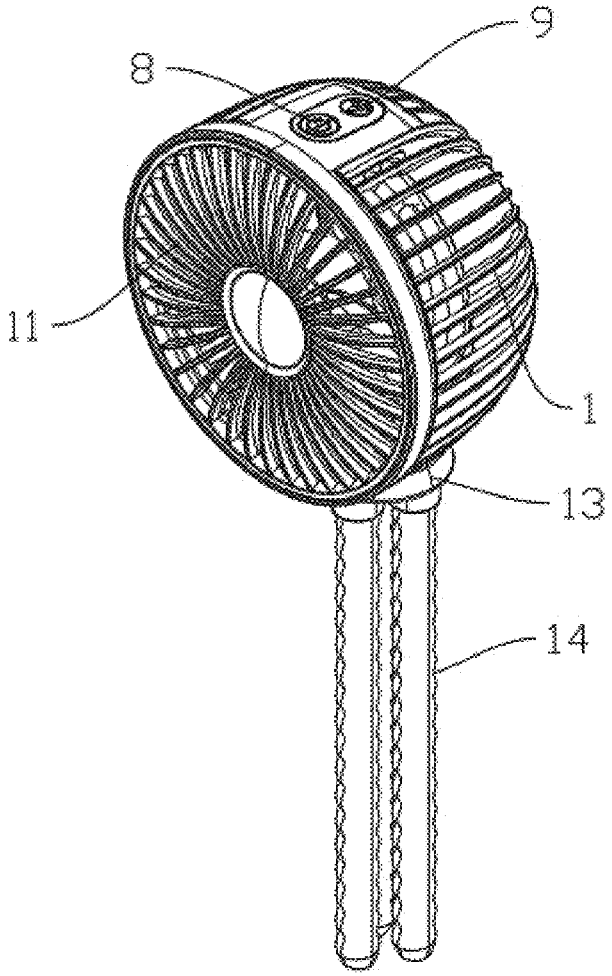
FIG. 3 is a structural schematic view of the portable oscillating fan according to the present invention.

Referring to FIGS. 1-3, the present invention provides a technical solution: a portable oscillating fan, comprising a rear cover (1), a mounting cavity (2), a mounting plate (3), a battery (4), a charging module (5), a charging interface (6), a switch circuit board (7), a power switch (8), an oscillation switch (9), a motor fan (10), a front cover (11), a receiving groove (12), a mounting base (13), leg tubes (14), and an oscillation motor (15). The rear part of the rear cover (1) is fitted with a mounting cavity (2), and a mounting plate (3) is installed inside the rear cover (1). A battery (4) is installed inside the mounting cavity (2) behind the mounting plate (3), and a charging module (5) is installed above the battery (4) at the rear of the mounting cavity (2). The charging interface (6) is installed on the charging module (5). The switch circuit board (7) is installed on the upper part of the mounting plate (3), and the power switch (8) and oscillation switch (9) are installed on the switch circuit board (7). The motor fan (10) is installed at the front of the mounting plate (3). A front cover (11) is installed on the front of the rear cover (1). A receiving groove (12) is arranged below the mounting cavity (2) on the rear cover (1), and a mounting base (13) is rotatably installed inside the receiving groove (12). Multiple leg tubes (14) are installed on the lower part of the mounting base (13). An oscillation motor (15) is installed at the lower part inside the mounting cavity (2), and the output end of the oscillation motor (15) is connected to the mounting base (13).

In this invention, a positioning protrusion (16) is arranged on the lower part of the mounting plate (3), and a positioning slot (17) is provided on the receiving groove (12). The positioning protrusion (16) falls into the positioning slot (17) when in the installed state, facilitating the restriction of the angle of the mounting plate (3) during installation, thereby making the installation positioning easier.

In this invention, the motor fan (10) is a fan structure with a motor installed in the center. The integrated motor fan (10) helps reduce the overall size of the fan.

In this invention, the upper end of each leg tube (14) is provided with a protrusion, and the leg tubes (14) are inserted into the lower part of the mounting base (13) through the protrusions on top. Inserting the protrusions into the mounting base (13) facilitates the installation of the leg tubes (14), thereby increasing the convenience of assembling and disassembling the leg tubes (14).

In this invention, the oscillation motor (15) is a motor integrated with a forward and reverse rotation circuit. The oscillation motor (15) is electrically connected to the battery (4) through the oscillation switch (9) and the switch circuit board (7). The motor fan (10) is electrically connected to the battery (4) through the power switch (8) and the switch circuit board (7). The charging module (5) is electrically connected to the battery (4), thereby enabling the switch control of the oscillation motor (15) and the motor fan (10).

For those skilled in the art, all electrical components in this invention are connected to their matching power sources via wires, and appropriate controllers should be selected based on actual conditions to meet control requirements. The specific connection and control sequence should follow the working principles described below, completing electrical connections in the order of operation of each electrical component. The detailed connection methods are well-known technologies in the field. The following mainly describes the working principles and processes without further elaboration on electrical control.

In this embodiment:

During use, by changing the shape of multiple leg tubes (14), the fan can be easily fixed in different positions. The battery (4) can be conveniently charged through the charging interface (6) in conjunction with the charging module (5). When blowing air is needed, the power switch (8) is turned on, and the switch circuit board (7) connects the power supply of the battery (4) to the motor fan (10), causing the motor fan (10) to operate and blow air. When it is necessary to increase the blowing range, the oscillation switch (9) is turned on, which powers the oscillation motor (15) through the battery (4). The output end of the oscillation motor (15) is connected to the mounting base (13), thereby driving the mounting cavity (2) and subsequently the rear cover (1) to rotate back and forth, increasing the range of the airflow angle. The mounting base (13), in conjunction with the receiving groove (12), limits the position of the mounting base (13) while saving space.

It should be noted that in this document, terms like "first" and "second" are only used to distinguish one entity or operation from another and do not necessarily require or imply any such actual relationship or order between these entities or operations. Moreover, the terms "comprise," "include," or any variations thereof are intended to cover a non-exclusive inclusion, so that a process, method, article, or device that includes a list of elements not only includes those elements but also other elements not expressly listed or inherent to such a process, method, article, or device. Without further constraints, the phrase "comprising a . . . defined element does not exclude the existence of additional identical elements in a process, method, article, or device that includes the stated elements."

Although embodiments of the present invention have been shown and described, it will be understood by those skilled in the art that various changes, modifications, substitutions, and variations can be made to these embodiments without departing from the principles and spirit of the present invention. The scope of the present invention is defined by the appended claims and their equivalents.

What is claimed is:

1. A portable oscillating fan, comprising a rear cover, a mounting cavity, a mounting plate, a battery, a charging module, a charging interface, a switch circuit board, a power switch, an oscillation switch, a motor fan, a front cover, a receiving groove, a mounting base, leg tubes, and an oscillation motor, wherein a rear part of the rear cover is fitted with the mounting cavity, the mounting plate is installed inside the rear cover, the battery is installed inside the mounting cavity behind the mounting plate, the charging module is installed above the battery at the rear of the mounting cavity, the charging interface is installed on the charging module, the switch circuit board is installed on an upper part of the mounting plate, the power switch and the oscillation switch are installed on the switch circuit board, the motor fan is installed at the front of the mounting plate, the front cover is installed on the front of the rear cover, the receiving groove is arranged below the mounting cavity on the rear cover, the mounting base is rotatably installed inside the receiving groove, the leg tubes are installed on a lower part of the mounting base, and the oscillation motor is installed on a lower part inside the mounting cavity, with an output end of the oscillation motor connected to the mounting base; a lower part of the mounting plate is provided with a positioning protrusion, and the receiving groove is provided with a positioning slot, wherein the positioning protrusion falls into the positioning slot when in the installed state.

2. The portable oscillating fan according to claim 1, characterized in that: the motor fan is a fan structure with a motor installed in the center.

3. The portable oscillating fan according to claim 1, characterized in that: an upper end of each of the leg tubes is provided with a protrusion, and the leg tubes are inserted into the lower part of the mounting base via the protrusions on top.

4. The portable oscillating fan according to claim 1, characterized in that: the oscillation motor is a motor integrated with a forward and reverse rotation circuit, the oscillation motor is electrically connected to the battery through the oscillation switch and the switch circuit board, the motor fan is electrically connected to the battery through the power switch and the switch circuit board, and the charging module is electrically connected to the battery.

* * * * *